US011352732B2

(12) United States Patent
Chun et al.

(10) Patent No.: US 11,352,732 B2
(45) Date of Patent: Jun. 7, 2022

(54) WASHING MACHINE

(71) Applicant: SAMSUNG ELECTRONICS CO., LTD., Suwon-si (KR)

(72) Inventors: Kwang Min Chun, Suwon-si (KR); Hong-Yeol Lee, Yongin-si (KR); Seon Ho Jeong, Suwon-si (KR)

(73) Assignee: SAMSUNG ELECTRONICS CO., LTD, Suwon-si (KR)

( * ) Notice: Subject to any disclaimer, the term of this patent is extended or adjusted under 35 U.S.C. 154(b) by 214 days.

(21) Appl. No.: 15/835,920

(22) Filed: Dec. 8, 2017

(65) Prior Publication Data

US 2018/0179687 A1 Jun. 28, 2018

(30) Foreign Application Priority Data

Dec. 23, 2016 (KR) ..... 10-2016-0178584

(51) Int. Cl.

| | |
|---|---|
| ***D06F 39/00*** | (2020.01) |
| ***D06F 37/26*** | (2006.01) |
| ***D06F 37/20*** | (2006.01) |
| ***D06F 23/04*** | (2006.01) |
| ***D06F 23/02*** | (2006.01) |
| *D06F 29/00* | (2006.01) |
| *D06F 31/00* | (2006.01) |
| *D06F 39/12* | (2006.01) |

(52) U.S. Cl.

CPC ..... *D06F 39/001* (2013.01); *D06F 23/02* (2013.01); *D06F 23/04* (2013.01); *D06F 37/20* (2013.01); *D06F 37/267* (2013.01); *D06F 29/00* (2013.01); *D06F 31/00* (2013.01); *D06F 39/12* (2013.01)

(58) Field of Classification Search

CPC ..... D06F 39/001; D06F 39/12; D06F 37/20; D06F 37/24; D06F 37/26; D06F 37/264; D06F 37/267; D06F 29/00; D06F 29/005; D06F 31/00; D06F 23/04; D06F 21/06

See application file for complete search history.

(56) References Cited

U.S. PATENT DOCUMENTS

2004/0037640 A1* 2/2004 Kim ..... D06F 39/001 403/408.1
2004/0237602 A1* 12/2004 Lappoehn ..... D06F 39/001 68/3 R (Continued)

FOREIGN PATENT DOCUMENTS

CN 1531612 A 9/2004
CN 106149276 A 11/2016

(Continued)

OTHER PUBLICATIONS

International Search Report dated Mar. 26, 2018 in International Patent Application No. PCT/KR2017/014052.
Extended European Search Report dated Sep. 13, 2019 from European Patent Application No. 17882796.0, 6 pages.
Chinese Office Action dated Dec. 28, 2020 from Chinese application No. 201780086126.7, 16 pages total.

(Continued)

*Primary Examiner* — David G Cormier
(74) *Attorney, Agent, or Firm* — Staas & Halsey LLP

(57) ABSTRACT

Disclosed herein are a washing machine comprising, a first tub, a second tub disposed above the first tub, a first housing configured to cover the first tub, a second housing disposed on the first housing, and configured to cover the second tub, and a first coupling portion protruding from the second tub toward the second housing, and configured to fix the second tub on the second housing.

8 Claims, 8 Drawing Sheets

(56) References Cited

U.S. PATENT DOCUMENTS

| | | | | |
|---|---|---|---|---|
| 2005/0229643 | A1* | 10/2005 | Kim | D06F 39/001 68/3 R |
| 2006/0059960 | A1* | 3/2006 | Hansen | D06F 37/20 68/23.1 |
| 2007/0289339 | A1* | 12/2007 | Lim | D06F 37/20 68/23.1 |
| 2009/0139275 | A1 | 6/2009 | Kim et al. | |
| 2009/0158784 | A1 | 6/2009 | Kim et al. | |
| 2011/0041560 | A1* | 2/2011 | Lee | D06F 29/00 68/9 |
| 2012/0024020 | A1 | 2/2012 | Kwon et al. | |
| 2016/0204682 | A1 | 7/2016 | Jeong et al. | |
| 2016/0215432 | A1 | 7/2016 | Kim | |
| 2018/0171534 | A1* | 6/2018 | Chae | D06F 29/00 |

FOREIGN PATENT DOCUMENTS

| | | |
|---|---|---|
| KR | 10-2008-0109488 | 12/2008 |
| KR | 10-2010-0004728 | 1/2010 |
| KR | 10-2015-0058885 | 5/2015 |
| WO | 2007/033925 | 3/2007 |

OTHER PUBLICATIONS

European Search Report dated Jun. 18, 2021 from European Application No. 17 882 796.0-1016.

Chinese Office Action dated Sep. 27, 2021 from Chinese Application No. 201780086126.7.

Chinese Office Action dated Apr. 13, 2022 from Chinese Application No. 201780086126.7.

* cited by examiner

WASHING MACHINE

CROSS-REFERENCE TO RELATED APPLICATION

This application claims the benefit of Korean Patent Application No. 10-2016-0178584, filed on Dec. 23, 2016 in the Korean Intellectual Property Office, the disclosure of which is incorporated herein by reference.

BACKGROUND

1. Field

Embodiments of the present disclosure relate to a washing machine, and more particularly, to a washing machine including a plurality of washing apparatuses.

2. Description of the Related Art

In general, a washing machine is an apparatus for washing laundry by rotating a rotation tub in the shape of a cylinder in which laundry is contained. Washing machines are classified into a washing machine in which a rotation tub is disposed horizontally so that when the rotation tub rotates on a horizontal shaft, laundry rises upward along the inner circumferential surface of the rotation tub and then falls to thereby be washed, and a washing machine in which a rotation tub having a pulsator therein is disposed vertically so that when the rotation tub rotates on a vertical shaft, laundry is washed by a water current generated by the pulsator.

The washing machine in which the rotation tub is disposed horizontally is called a front loading washing machine since a laundry entrance is formed in the front portion, and the washing machine in which the rotation tub is disposed vertically is called a top loading washing machine since a laundry entrance is formed in the upper portion.

Meanwhile, since a typical washing machine has a single washing apparatus, a user who wants to sort laundry and wash the laundry separately should drive the washing machine two times or more. Accordingly, the user had to operate the washing machine for a long time even when washing a small amount of laundry.

SUMMARY

Therefore, it is an aspect of the present disclosure to provide a washing machine having a plurality of washing apparatuses.

It is another aspect of the present disclosure to provide a washing machine capable of fixing a tub with a coupling member that can be separated from the rear surface of the tub.

Additional aspects of the disclosure will be set forth in part in the description which follows and, in part, will be obvious from the description, or may be learned by practice of the disclosure.

In accordance with one aspect of the present disclosure, a washing machine comprising: a first tub; a second tub disposed above the first tub; a first housing configured to cover the first tub; a second housing disposed on the first housing, and configured to cover the second tub; and a first coupling portion protruding from the second tub toward the second housing, and configured to fix the second tub on the second housing.

Also, a washing machine comprising a second coupling portion formed in the second tub, and configured to fix the second tub on the first housing.

Also, the first coupling portion includes a boss integrated into the second tub in such a way to protrude from the second tub.

Also, the first coupling portion includes a first coupling hole formed in the boss.

Also, the boss further includes a reinforcement rib.

Also, the second coupling portion includes a second coupling bracket extending integrally from a lower end of a rear surface of the second tub.

Also, the second coupling portion includes a second coupling hole formed in the second coupling bracket.

Also, the first coupling hole is provided to fix the second tub on the second housing.

Also, the second coupling hole is provided to fix the second tub on the first housing.

Also, the washing machine comprising a fixer member configured to fix the first coupling portion and the second coupling portion on the first housing and the second housing.

Also, the fixer member includes a fixer guide having a cavity, and a fixer configured to pass through the fixer guide to be coupled with the first coupling portion and the second coupling portion.

Also, the second housing includes an upper frame including an entrance through which laundry is put into the second tub, and a lower frame disposed below the upper frame.

Also, the lower frame includes a first inserting hole formed to correspond to the first coupling hole.

Also, the first housing includes a second inserting hole formed to correspond to the second coupling hole.

Also, the fixer member further includes an elastic member, and the elastic member is disposed between the fixer guide and the first inserting hole.

Also, the second housing further includes a rear cover configured to cover a rear surface of the upper frame and a rear surface of the lower frame, and wherein the rear cover includes a coupling member installing hole formed to correspond to the first coupling hole.

Also, the second coupling hole is formed below the first coupling hole.

In accordance with another aspect of the present disclosure, a washing machine comprising: a first housing in which a first tub is disposed, and whose upper portion opens; a second housing in which a second tub is disposed, and which is located below the first housing; a first coupling portion integrated into the second tub in such a way to protrude from the second tub toward the second housing, and configured to fix the second tub on the second housing; and a second coupling portion disposed on the second tub, and configured to fix the second tub on the first housing.

Also, the first coupling portion includes a boss integrated into the second tub in such a way to protrude from the second tub, and a second coupling hole formed in the boss.

Also, the washing machine comprising a fixer member configured to fix the first coupling portion and the second coupling portion on the first housing and the second housing.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
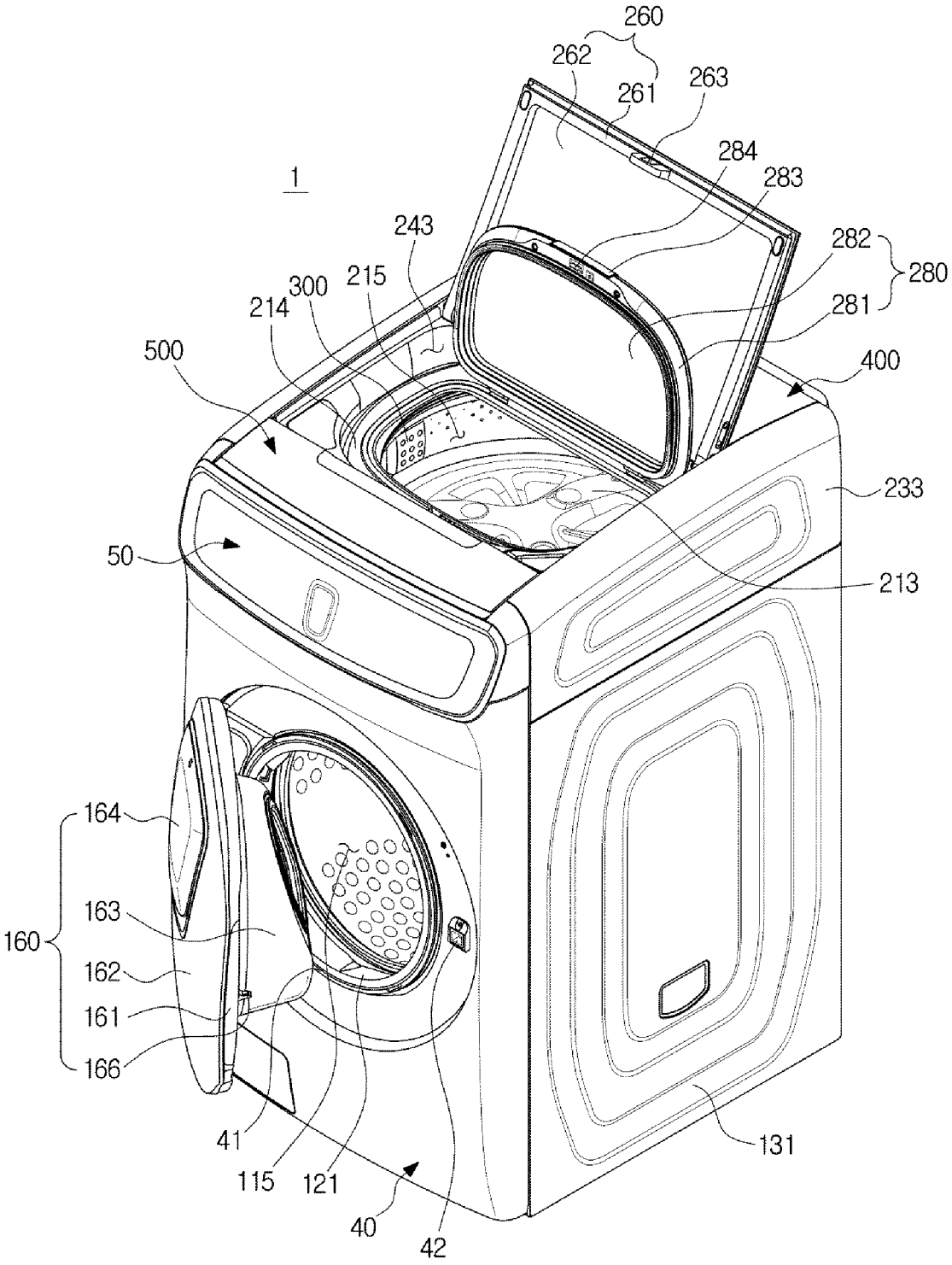
FIG. 1 shows a perspective view of a washing machine according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, the embodiments of the present disclosure will be described in detail with reference to the accompanying drawings.

Figure 2:
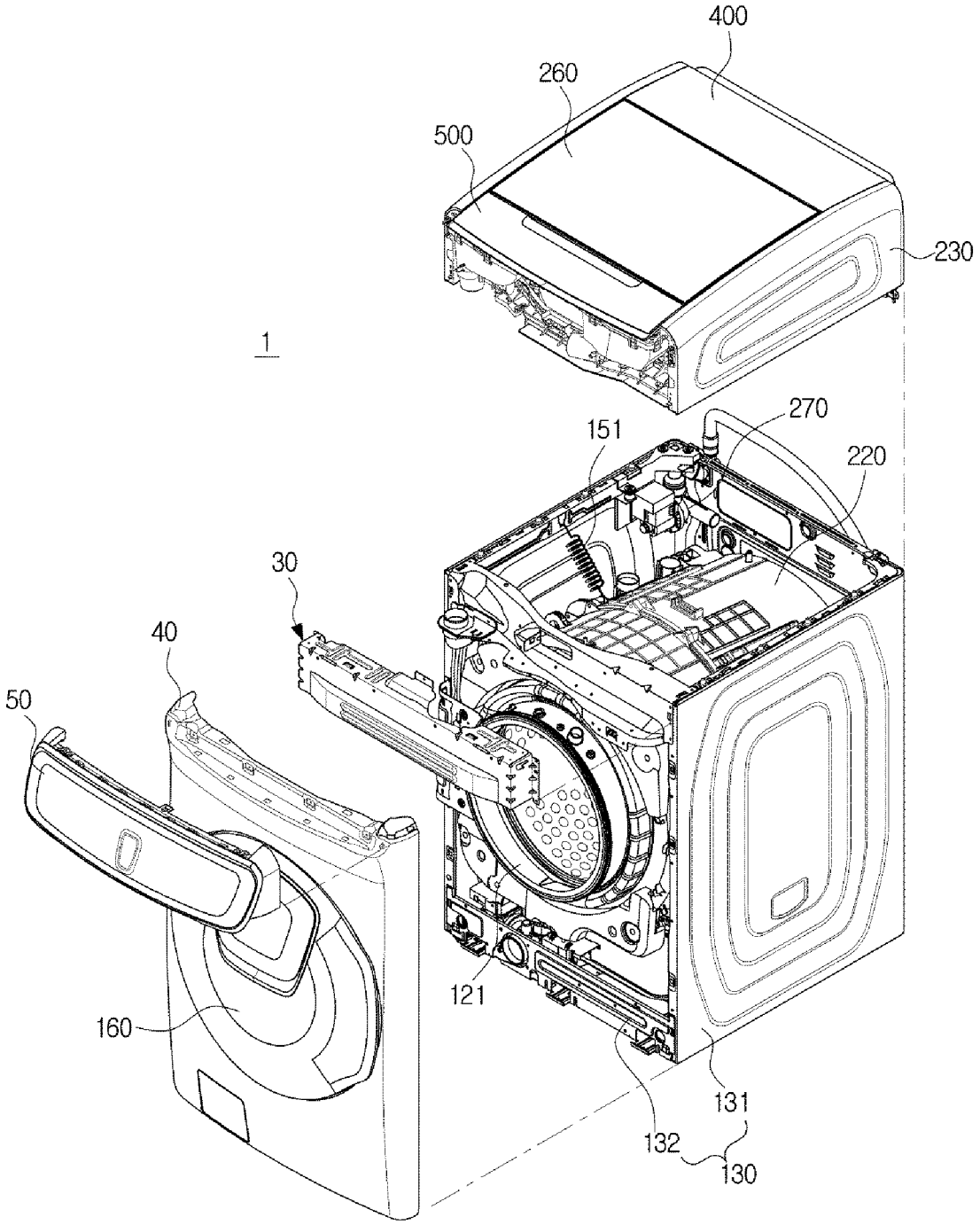
FIG. 2 is an exploded perspective view of a part of the washing machine shown in FIG. 1.
Figure 3:
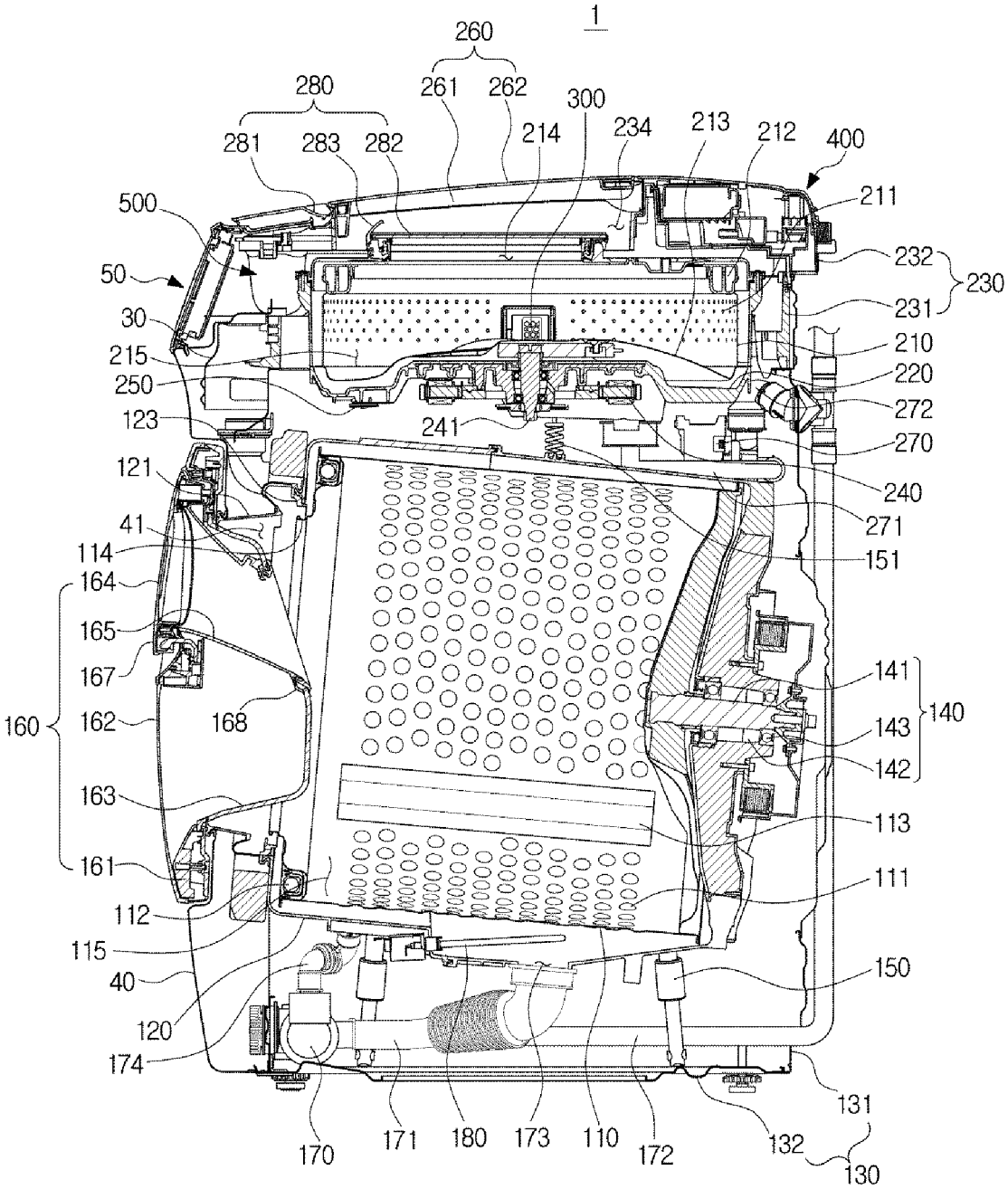
FIG. 3 is a cross-sectional view of the washing machine shown in FIG. 1.

FIG. 1 is a perspective view of a washing machine according to an embodiment of the present disclosure, FIG. 2 is an exploded perspective view of a part of the washing machine shown in FIG. 1, and FIG. 3 is a cross-sectional view of the washing machine shown in FIG. 1.

As shown in FIGS. 1, 2, and 3, a washing machine 1 may include a first washing apparatus of a front loading type in which a laundry entrance is formed in the front portion, and a second washing apparatus of a top loading type in which a laundry entrance is formed in the upper portion.

As shown in FIGS. 1, 2, and 3, a washing machine 1 may include a first washing apparatus of a front loading type in which a laundry entrance is formed in the front portion, and a second washing apparatus of a top loading type in which a laundry entrance is formed in the upper portion.

The washing machine 1 may include a first drum 110 forming a first washing space 115 therein, and a first tub 120 accommodating the first drum 110 and storing washing water or rinsing water to be used for a washing course or a rinsing course. The first drum 110 and the first tub 120 may be in the shape of a cylinder having an opening at one side, wherein the opening may face forward.

The washing machine 1 may include a first housing 130 in which the first drum 110 and the first tub 120 are disposed. More specifically, the first housing 130 may include a plurality of side frames 131 forming side and rear plates, and a bottom frame 132 forming a bottom plate.

Also, the washing machine 1 may include a spring 151 and a damper 150 to support the first tub 120 on the first housing 130. The damper 150 may connect the outer surface of the first tub 120 to the bottom plate 132 to support the first tub 120 from below, and the spring 151 may connect the outer surface of the first tub 120 to a spring coupling portion 133 disposed at an upper portion of the first side frames 131 to support the first tub 120 from above. The spring 151 and the damper 150 may cushion vibrations, noise, and impacts generated when the first tub 120 moves.

However, the installation positions of the spring 151 and the damper 150 may be not limited to the upper portion of the first side frame 131 and the bottom plate 132, and the spring 151 and the damper 150 may connect one surface of the first tub 120 to a portion of the first housing 130, as necessary, to support the first tub 120.

The washing machine 1 may include a first driving motor 140 disposed behind the first tub 120, and configured to rotate the first drum 110. A rear surface of the first drum 110 may be connected to a first driving shaft 141 for transferring power of the first driving motor 140.

In a circumferential side of the first drum 110, a plurality of through holes 111 may be formed to pass washing water through. On an inner circumferential surface of the first drum 110, a plurality of lifters 113 may be installed so that laundry rises and falls when the first drum 110 rotates. In the front portion of the first drum 110, a first balancer 112 may be installed so that the first drum 110 can rotate stably at high speed.

The first driving shaft 141 may be disposed between the first drum 110 and the first driving motor 140. One end of the first driving shaft 141 may be connected to the rear plate of the first drum 110, and the other end of the first driving shaft 141 may extend outward from a rear wall of the first tub 120. If the first driving motor 140 drives the first driving shaft 141, the first drum 110 connected to the first driving shaft 141 may rotate on the first driving shaft 141.

On the rear wall of the first tub 120, a bearing housing 142 may be installed to rotatably support the first driving shaft 141. The bearing housing 142 may be made of an aluminum alloy, and may be inserted into the rear wall of the first tub 120 when the first tub 120 is injection-molded. Between the bearing housing 142 and the first driving shaft 141, a plurality of bearings 143 may be installed to smoothly rotate the first driving shaft 141.

The washing machine 1 may have a function of washing laundry with high-temperature water. In order to acquire high-temperature water, a heater 180 for heating washing water or rinsing water accommodated in the first tub 120 may be disposed below the first tub 120.

The washing machine 1 may include a first drain pump 170 disposed below the first tub 120, and configured to discharge water inside the first tub 120 to the outside of the washing machine 1, a first connection hose 171 connecting a first outlet 173 of the first tub 120 to the first drain pump 170 so that water inside the first tub 120 can flow to the first drain pump 170, a circulation hose 174 connecting the first drain pump 170 to the first tub 120 to circulate water flowed to the first drain pump 170 to the first tub 120, and a first drain hose 172 to guide water pumped by the first drain pump 170 to the outside of the washing machine 1.

The washing machine 1 may include a front cover 40 having a first entrance 41 through which laundry can be put into the first washing space 115, and a first door 160 for opening or closing the first entrance 41 may be coupled with the front cover 40.

The first door 160 may be disposed to correspond to the first entrance 41, in such a way to rotate with respect to the front cover 40. The first door 160 may include a first door frame 161, a first door cover 162, and a door glass 163.

In the current embodiment of the present disclosure, the first door frame 161 may be in the shape of a ring, however, the first door frame 161 may be in the shape of a rectangle. The first door cover 162 and the door glass 163 may be made of a transparent material, so that the user can see the inside of the first drum 110 from the outside of the washing machine 1 when the first door 160 closes the first entrance 41. The door glass 163 may protrude convexly toward the inside of the first drum 110 from the first door frame 161. Through the structure, the door glass 163 can be inserted inward from the first entrance 41, when the first door 160 closes.

A first hinge may be disposed around the first entrance 41 so that the first door 160 can rotate with respect to the front cover 40, and the first hinge may be coupled with a first hinge coupling portion formed at one edge of the first door frame 162. At the opposite edge of the first door frame 161, a first hook 166 may be disposed, and a first hook accommodating portion 42 may be formed in the front cover 40 in correspondence to the first hook 166, so that the first door 160 can be fixed when it closes the first entrance 41.

In order for the user to put laundry into the first washing space 115 when the first door 160 is in a closed state, the first door 160 may include an auxiliary laundry entrance 167, and an auxiliary door 164 for opening or closing the auxiliary laundry entrance 167. The auxiliary door 164 may be rotatably installed on the first door cover 162.

In order for the user to put laundry into the inside of the washing machine 1 through the auxiliary laundry entrance 167 of the first door 160, the laundry may need to pass through the door glass 163. For this, a glass through hole 168 may be formed in the door glass 163. Alternatively, the upper portion of the door glass 163 may be depressed so that no door glass is disposed behind the auxiliary laundry entrance 167.

In order to connect the auxiliary laundry entrance 167 of the first door 160 to the glass through hole 168 of the door glass 163, the first door 160 may include a connection guide portion 165. The connection guide portion 165 may be in the shape of a tube that opens at both ends and has a cavity.

More specifically, one end of the connection guide portion 165 may be connected to the auxiliary laundry entrance 167, and the other end of the connection guide portion 165 may be connected to the glass through hole 168. In the current embodiment, the connection guide portion 165 may be inclined downward toward the rear direction. That is, one end of the connection guide portion 165 connected to the auxiliary laundry entrance 167 may be positioned higher than the other end of the connection guide portion 165. Through the structure, the user can easily put laundry into the inside of the first drum 110 through the auxiliary laundry entrance 167.

In the current embodiment, the auxiliary door 164 is installed in the first door 160, however, the first door 160 may include none of the auxiliary laundry entrance 167, the auxiliary door 165, and the connection guide portion 165.

The washing machine 1 may include a diaphragm 121 disposed between the first entrance 41 of the front cover 40 and the opening 123 of the first tub 120. The diaphragm 121 may form a passage arriving at the opening 114 of the first drum 110 from the first entrance 41, and may reduce vibrations transferred toward the front cover 40 when the first drum 110 rotates. A part of the diaphragm 121 may be disposed between the first door 160 and the front cover 40 to prevent washing water in the first tub 120 from leaking out of the washing machine 1.

The washing machine 1 may include a second drum 210 forming a second washing space 215 therein, and a second tub 220 accommodating the second drum 210 and storing washing water or rinsing water that is to be used for a washing course or a rinsing course. The second drum 210 and the second tub 220 may be in the shape of a cylinder having an opening at one side, wherein the opening may face upward.

The washing machine 1 may include a second housing 230 which accommodates the second drum 210 and the second tub 220 therein. More specifically, the second housing 230 may include a lower frame 231 on which the second tub 220 is supported, and a upper frame 232 including a second entrance 243 through which the user can put laundry into the second washing space 215, the upper frame 232 mounted on the lower frame 231. Also, the second housing 230 may include a pair of side covers 233 forming the outer appearances of the left and right sides.

The washing machine 1 may include a second door 260 disposed on the second housing 230, and configured to open or close the second entrance 234. The second door 260 may be disposed to correspond to the second entrance 234, and configured to rotate with respect to the upper frame 232. The second door 260 may include a second door frame 261 and a second door cover 262. The second door cover 262 may be made of a transparent material, so that the user can see the second tub 220 and the second drum 210 from the outside of the washing machine 1 when the second door 260 closes the second entrance 234.

A second hinge may be disposed at left and right edges of the second door frame 261 so that the second door 260 can rotate with respect to the upper frame 232, and the second hinge may be coupled with a second hinge coupling portion formed around the second entrance 234. In a front edge of the second door frame 261, a latch accommodating portion 263 may be disposed, and a latch member may be disposed in the upper frame 232 to correspond to the latch accommodating portion 263 of the second door frame 261, so that the second door 260 can be fixed when it closes the second entrance 234.

The second drum 210 may be in the shape of a cylinder whose upper portion opens in such a way to be rotatable in the inside of the second tub 220. In side and bottom plates of the second drum 210, a plurality of through holes 211 may be formed to flow washing water through. In the upper portion of the second drum 210, a second balancer 212 may be installed so that the second drum 210 can rotate stably at high speed. A filter 300 may be attached on an inner side surface of the second drum 210 to filter out foreign materials generated during washing.

On the bottom of the second drum 210, a curved portion 213 may be formed to generate streams of water. Although not shown in the drawings, the washing machine 1 may further include a pulsator disposed in the inside of the second drum 210 and configured to generate streams of water.

The second tub 220 may be in the shape of a cylinder, and supported on the lower frame 231 by a suspension apparatus 250. More specifically, the second tub 220 may be supported in such a way to hang from the lower frame 231 by four suspension apparatuses 250. In the upper portion of the second tub 220, a third entrance 214 may be formed to correspond to the second entrance 234, and a third door 28 may be coupled with the upper portion of the second tub 220 to open or close the third entrance 214.

The third door 280 may include a third door frame 281 and a third door cover 282. The third door cover 282 may be made of a transparent material, so that the user can see the inside of the second drum 210 from the outside of the second tube 220 when the third door 280 closes the third entrance 214.

A third hinge may be disposed around the third entrance 214 so that the third door 280 can rotate with respect to the second tub 220, and the third hinge may be coupled with a third hinge coupling portion formed at one edge of the third door frame 281. At the opposite edge of the third door frame 281, a handle 283 may be disposed to open the third door 280, and a second hook 284 may be formed in the handle 283. A second hook accommodating portion may be formed in the second tub 220 in correspondence to the second hook 284, so that the third door 280 can be fixed when it closes the third entrance 214. When the handle 283 is pulled, the second hook 284 may be separated from the second hook accommodating portion to open the third door 280.

The washing machine 1 may include a second driving motor 240 disposed on the opposite surface of the bottom of the second tub 220, and configured to rotate the second drum 210. The bottom plate of the second drum 210 may be connected to a second driving shaft 241 for transferring power of the second driving motor 240. One end of the second driving shaft 241 may be connected to the bottom plate of the second drum 210, and the other end of the second driving shaft 241 may extend outward from a lower wall of the second tub 220. If the second driving motor 240 drives the second driving shaft 241, the second drum 210 connected to the second driving shaft 241 may rotate on the second driving shaft 241.

Although not shown in the drawings, if the pulsator is disposed on the bottom of the second drum 210, the washing machine 1 may further include a power switch apparatus for transferring a driving force generated by the second driving motor 240 simultaneously or selectively to the second drum 210 and the pulsator.

The washing machine 1 may include a second drain pump 270 disposed below the second tub 220 to discharge water in the inside of the second tub 220 to the outside of the washing machine 1, and a second drain hose 272 to guide water pumped by the second drain pump 270 to the outside of the washing machine 1. More specifically, the second drain pump 270 may be installed in the upper portion of the first housing 130.

In the bottom of the second tub 220, a second outlet 273 may be formed to discharge water stored in the inside of the second tub 220, and the second outlet 273 may be connected to the second drain pump 270 by the second connection hose 271 to cause water stored in the second tub 220 to flow to the second drain pump 270.

The washing machine 1 may include a water supply apparatus 400 to supply washing water to the first tub 120 and the second tub 220. The water supply apparatus 400 may be installed in the second housing 230. More specifically, the water supply apparatus 400 may be disposed on the upper frame 232, and preferably, the water supply apparatus 400 may be disposed behind the second entrance 234.

Also, the washing machine 1 may include a detergent supply apparatus 500 to supply detergents to the first tub 120. The detergent supply apparatus 500 may be disposed in the second housing 230. More specifically, the detergent supply apparatus 500 may be disposed on the upper frame 232, and preferably, the detergent supply apparatus 500 may be disposed in front of the second entrance 234.

The washing machine 1 may include a fixing bracket 30 to couple the second housing 130 with the first housing 130 such that the second housing 230 is not separated from the first housing 130. Also, the washing machine 1 may include a control panel 50 disposed on the front cover 40 to enable the user to manipulate the washing machine 1. The control panel 50 may include an input device to receive operation commands for the washing machine 1 from the user, and a display to display operation information of the washing machine 1.

Figure 4:
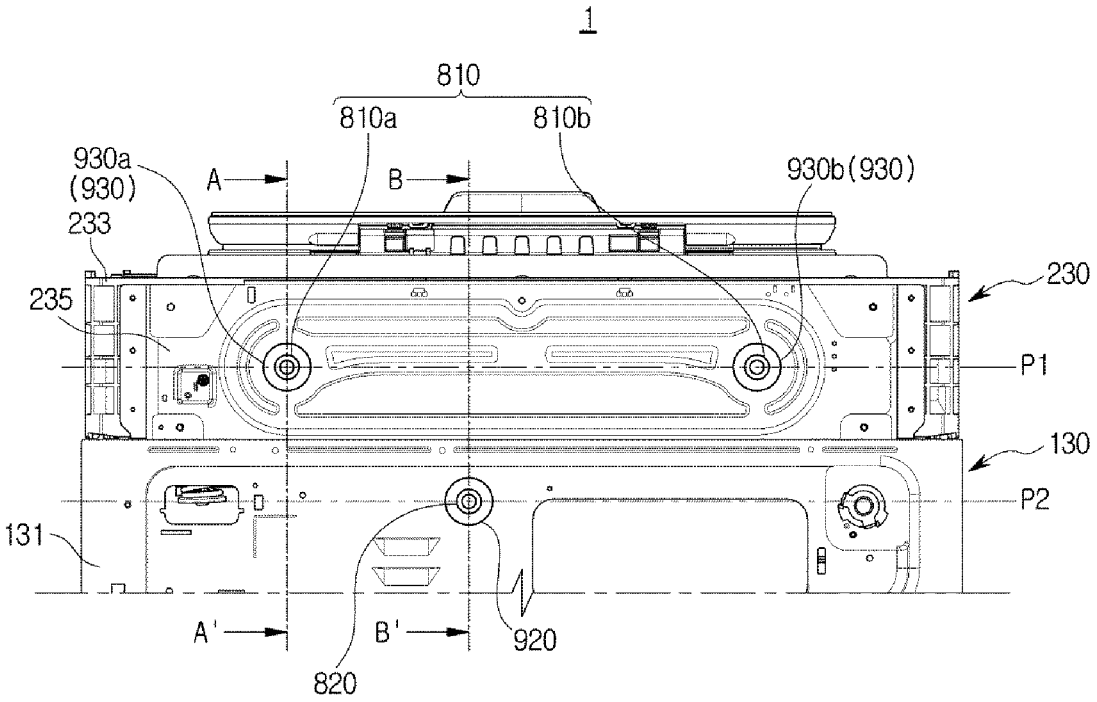
FIG. 4 shows a rear surface of the washing machine according to the embodiment of the present disclosure.
Figure 5:
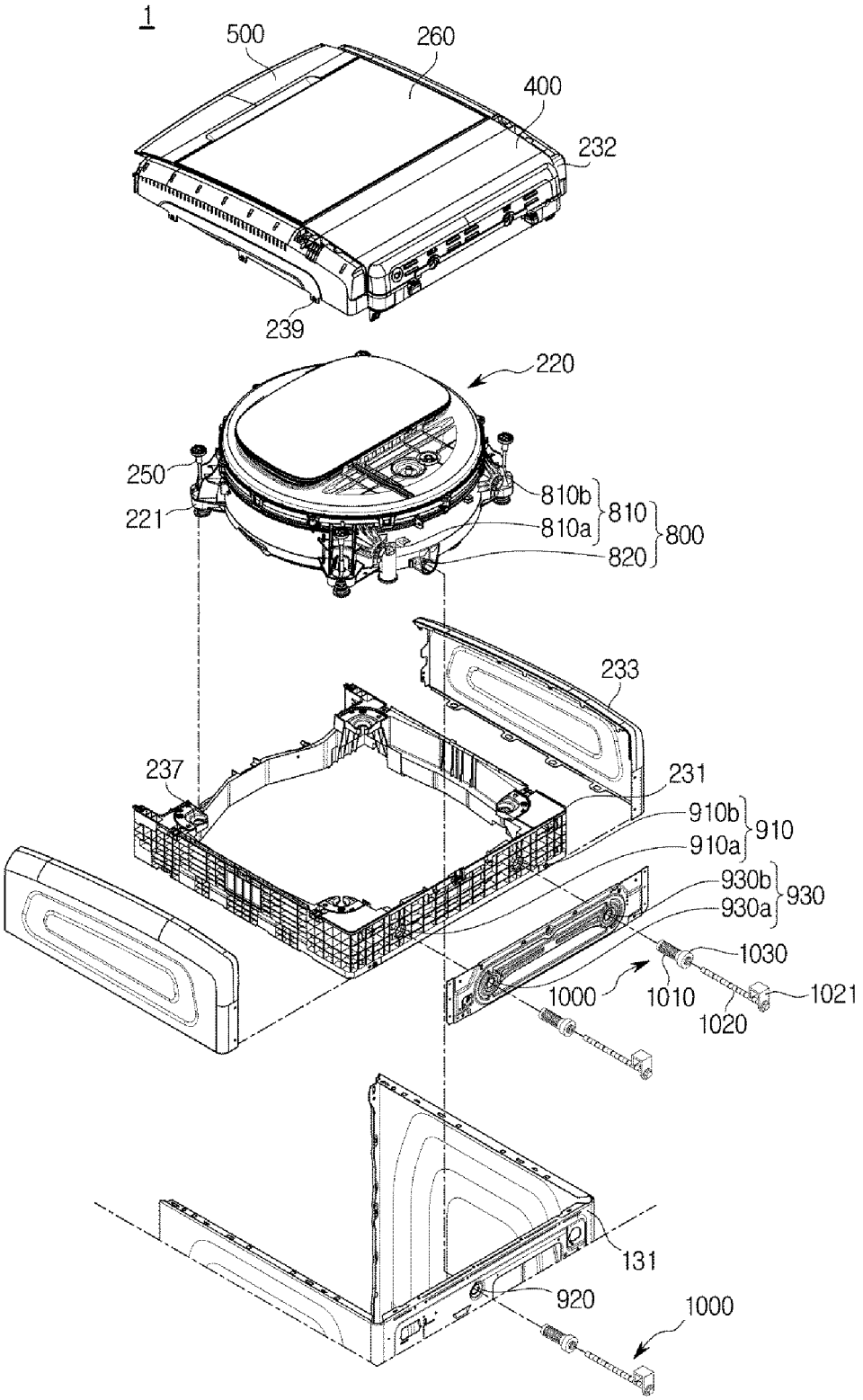
FIG. 5 is an exploded perspective view showing a fixer member installed in the washing machine according to the embodiment of the present disclosure.
Figure 6:
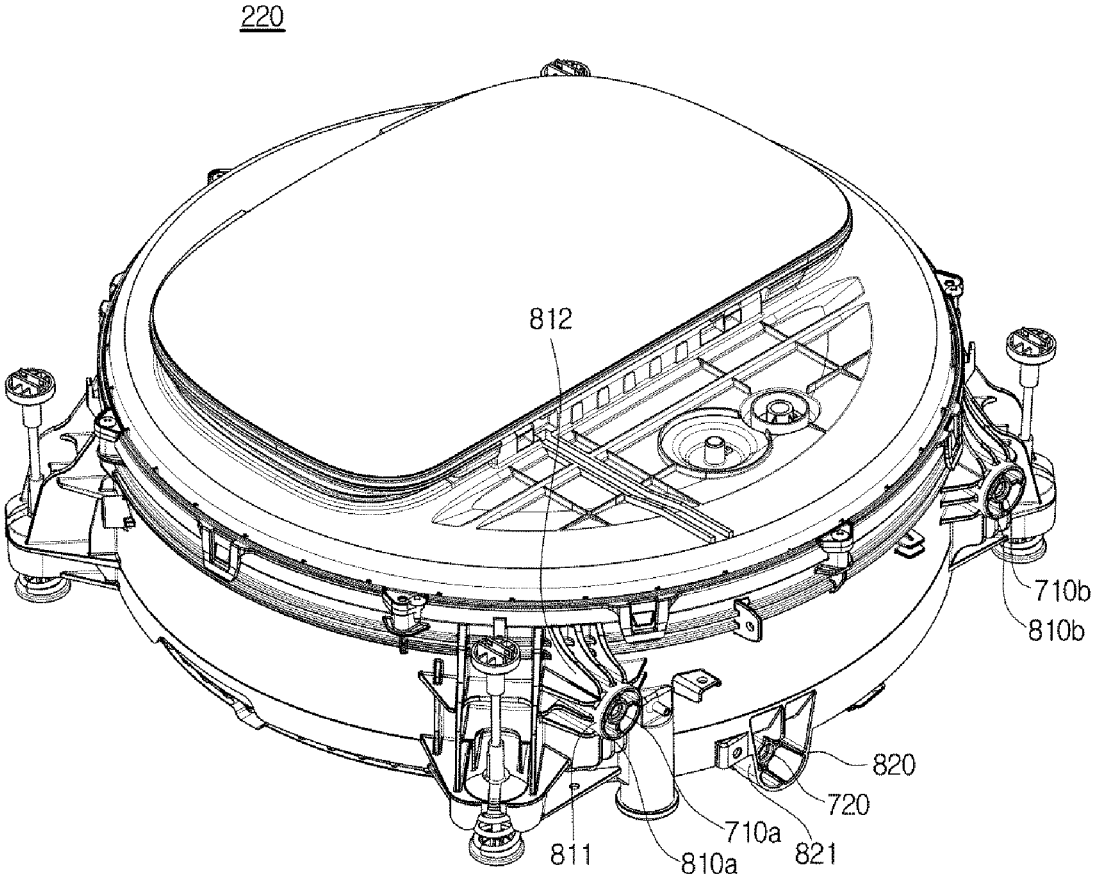
FIG. 6 is a perspective view of a second tub of the washing machine according to the embodiment of the present disclosure.
Figure 7:
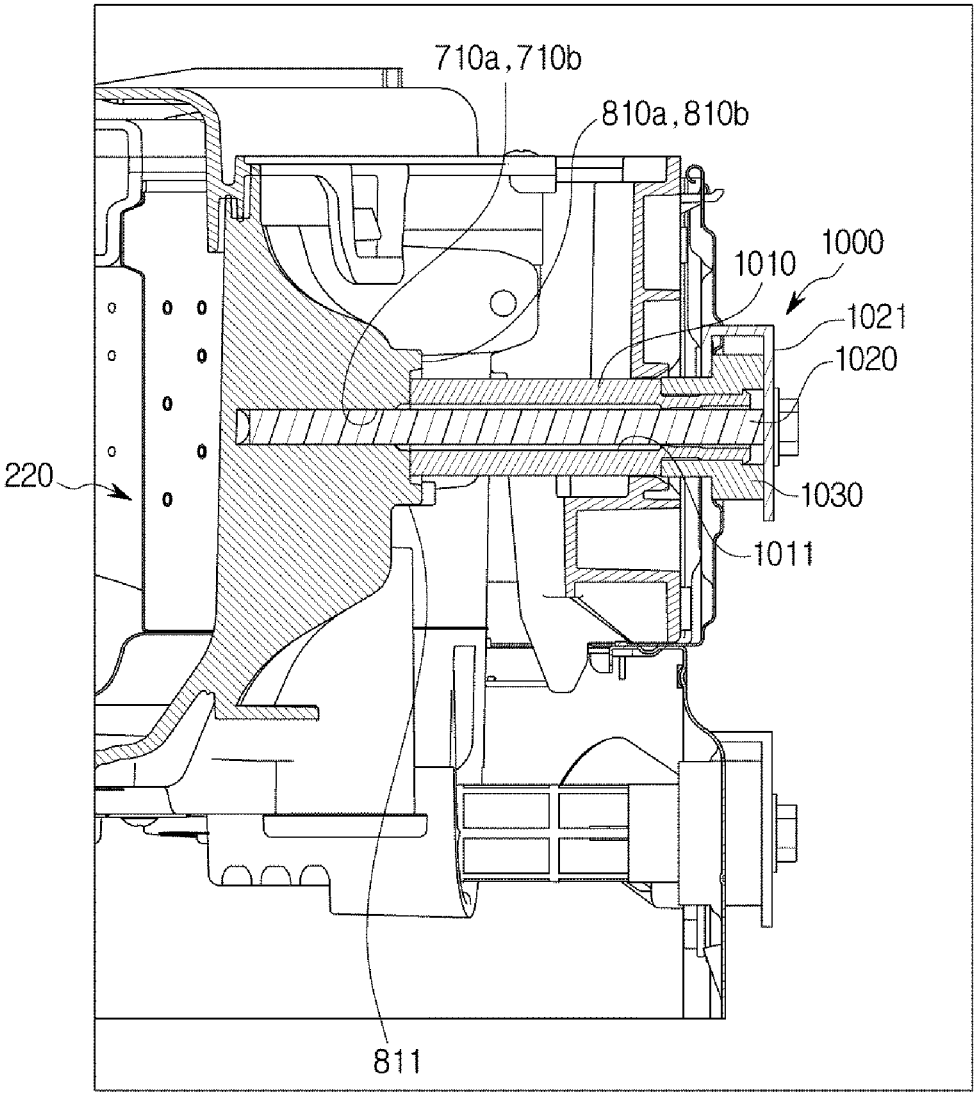
FIG. 7 is a cross-sectional view of the washing machine, taken along a line A-A' of FIG. 4.
Figure 8:
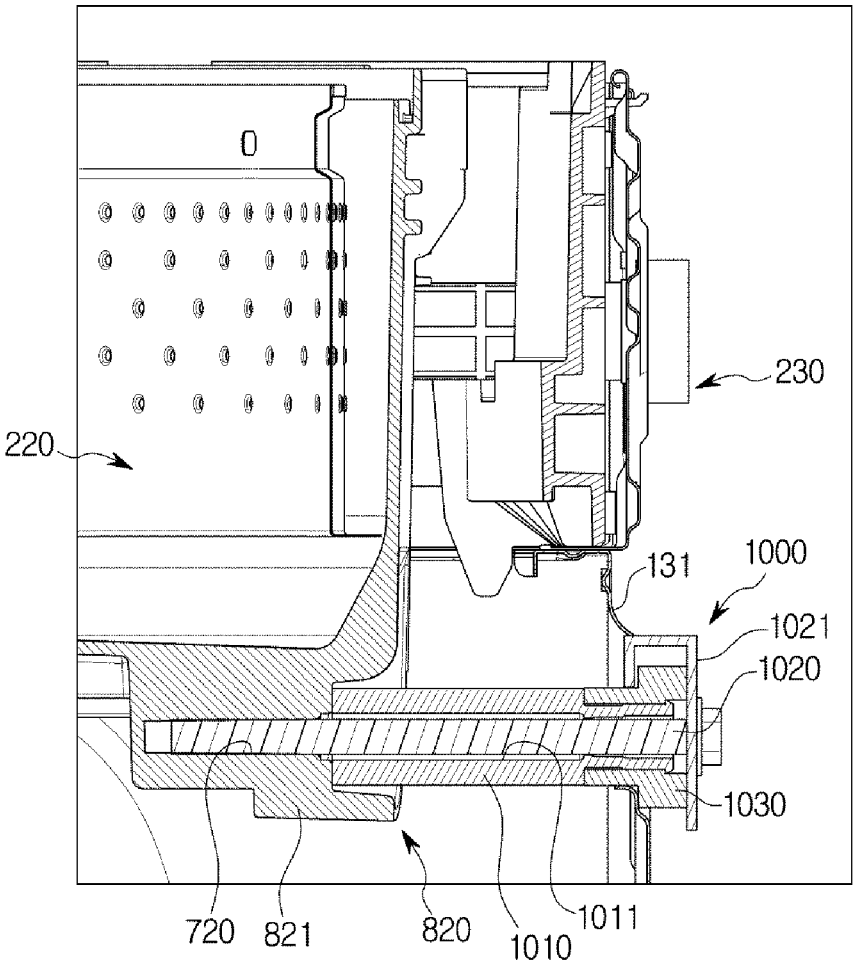
FIG. 8 is a cross-sectional view of the washing machine, taken along a line B-B' of FIG. 4.

FIG. 4 shows a rear surface of the washing machine according to the embodiment of the present disclosure, FIG. 5 is an exploded perspective view showing a fixer member installed in the washing machine according to the embodiment of the present disclosure, FIG. 6 is a perspective view of a second tub of the washing machine according to the embodiment of the present disclosure, FIG. 7 is a cross-sectional view of the washing machine, taken along a line A-A' of FIG. 4, and FIG. 8 is a cross-sectional view of the washing machine, taken along a line B-B' of FIG. 4.

As shown in FIGS. 4 to 7, the second tub 220 of the washing machine 1 may be fixed on the first housing 130 and the second housing 230 by a plurality of coupling portions 800. The second tub 220 may be detachably fixed on the first housing 130 and the second housing 230 by the plurality of coupling portions 800. The second tub 220 may be detachably coupled with the plurality of coupling portions 800 through a fixer member 1000.

The second housing 230 may cover the second tub 220. The second housing 230 may include a lower frame 231 on which the second tub 220 is supported, and a upper frame 232 including a second entrance 234 through which laundry can be put, the upper frame 232 mounted on the lower frame 231.

The second housing 230 may include the pair of side covers 233 forming the outer appearances of the left and right sides, and a rear cover 235 forming the outer appearance of the rear side.

The lower frame 231 may support the second tub 220. The lower frame 231 may include a first support portion 283 in which the suspension apparatuses 250 can be installed. The lower frame 231 may be in the shape of a hexahedron whose upper and lower portion open. A plurality of first support portions 238 may be respectively formed in the corners of the lower frame 231. The second tub 220 may include a second support portion 221 in which the suspension apparatuses 250 can be installed, in the lower portion. The suspension apparatuses 250 may connect the first support portion 238 of the lower frame 231 to the second support portion 221 of the second tub 220.

Since the front, rear, left, and right sides of the lower frame 231 are connected to surround the front, rear, left, and right portions of the second tub 220, and the first support portions 238 are respectively disposed in the upper corners of the lower frame 231, the lower frame 231 can have sufficient stiffness to support the second tub 220 by the four suspension apparatuses 250.

The upper frame 232 may include a first coupling portion 239 that can be coupled with the lower frame 231. A pair of first coupling portions 239 may be respectively disposed at the left and right lower ends of the upper frame 232. The lower frame 231 may include a second coupling portion 237 that can be coupled with the upper frame 232. The second coupling portion 237 may be disposed at the upper end of the lower frame 231 to correspond to the first coupling portions 239 of the upper frame 232.

The side covers 233 may be coupled with the upper frame 232 and the lower frame 231 to cover the side surfaces of the upper frame 232 and the side surfaces of the lower frame 231.

The rear cover 235 may be coupled with the rear surface of the lower frame 231 to cover the rear surface of the lower frame 231. The rear cover 235 may be fixed on the lower frame 231 by a separate fixing member such as a screw.

The plurality of coupling portions 800 may be disposed on the rear surface of the second tub 220. At least one part of the plurality of coupling portions 800 of the second tub 220 may be connected to the first housing 130, and the remaining part of the plurality of coupling portions 800 may be connected to the second housing 230.

The plurality of coupling portions 800 may include a first coupling portion 810 configured to fix the second tub 220 on the second housing 230, and a second coupling portion 820 configured to fix the second tub 220 on the first housing 130.

The first coupling portion 810 may protrude from the second tub 220 toward the second housing 230. The first coupling portion 810 may be integrated into the second tub 220 in such a way to protrude toward the second housing 230. A pair of first coupling portions 810 may be disposed side by side in a horizontal direction on the rear surface of the second tub 220. The first coupling portions 810 may be respectively positioned on the left and right sides of the second tub 220. Each first coupling portion 810 may include a boss 811 protruding from the second tub 220. The boss 811 may be integrated into the second tub 220 in such a way to protrude in a rear direction from the rear surface of the second tub 220. The boss 811 may be in the shape of a cylinder. A first coupling hole 710 may be formed in the boss 811. The first coupling hole 710 may be formed in the center of the boss 811. The boss 811 may include a reinforcement rib 812. A plurality of reinforcement ribs 812 may be formed around the boss 811. The reinforcement ribs 812 may be integrated into the second tub 220 to reinforce stiffness of the boss 811.

The first coupling portions 810 may be located at a first position P1 on the rear, upper surface of the second tub 220. The first coupling portions 810 may be respectively located to the left and right of the rear surface of the second tub 220.

The second coupling portion 820 may be disposed on the rear, lower end of the second tub 220. The second coupling portion 820 may be formed on the center end of the rear surface of the second tub 220. The second coupling portion 820 may protrude downward in the center of the rear surface of the second tub 220. The second coupling portion 820 may be integrated into the second tub 220 at the rear center portion of the second tub 220. The second coupling portion 820 may include a second coupling bracket 821. The second coupling bracket 821 may extend integrally from the lower end of the rear surface of the second tub 220. The second coupling portion 820 may include a second coupling hole 720. The second coupling hole 720 may be formed in the second coupling bracket 821. The second coupling portion 820 may be located at a second position P2 on the rear, lower surface of the second tub 220. The second coupling hole 720 may be located at the second position P2 on the rear surface of the second tub 220.

The first coupling portions 810 may be disposed at the first position P1 that is higher than the second coupling portion 820. The first coupling portions 810 may be located such that they are covered by the second housing 230, and the second coupling portion 820 may be located such that it is covered by the first housing 130. That is, the upper portion of the second tub 220 may be covered by the second housing 230, and the lower portion of the second tub 220 may be covered by the first housing 130. Also, a part of the upper portion of the second tub 220 may be covered by the second housing 230, and a part of the remaining lower portion of the second tub 220 may be covered by the first housing 130.

Meanwhile, in the second housing 230, a plurality of first insertion holes 910 may be formed to correspond to the first coupling portions 810 of the second tub 220. The first insertion holes 910 may be formed in the lower frame 231 of the second housing 230. The first insertion holes 910 may be formed in the rear side of the lower frame 231. More specifically, a pair of first insertion holes 910*a* and 910*b* may be formed in the rear side of the lower frame 231. The first insertion holes 910*a* and 910*b* may be formed to correspond to a pair of first coupling holes 710*a* and 710*b* of the first coupling portion 810*a* and 810*b*.

Also, in the rear cover 235 coupled with the lower frame 231 of the second housing 230, a plurality of fixer member installing portions 930 may be formed to correspond to the first insertion holes 910. More specifically, a pair of fixer member installing portions 930 may be respectively formed to the left and right of the rear cover 235. The pair of fixer member installing portions 930 may be formed to the left and right of the rear cover 235 to correspond to the first coupling holes 710*a* and 710*b*. The fixer member installing portions 930 may include a pair of fixer member installing holes 930*a* and 930*b* to correspond to the first coupling holes 710*a* and 710*b*. The fixer member 1000 which will be described later may pass through the fixer member installing holes 930*a* and 930*b* of the fixer member installing portions 930.

In the first housing 130, a second inserting hole 920 may be formed to correspond to the second coupling portion 820 of the second tub 220. The second inserting hole 920 may be formed in the rear one of the side frames 131 of the first housing 130. The second inserting hole 920 may be formed in the upper portion of the side frame 131. The second inserting hole 920 may be formed to correspond to the second coupling portion 820. The second inserting hole 920 may be located at the upper, center portion of the side frame 131.

The first coupling portions 810 and the second coupling portion 820 of the second tub 220 may be fixed on the first housing 130 and the second housing 230 by the fixer member 1000.

The fixer member 1000 may include a fixer guide 1010, and a fixer 1020 passing through the fixer guide 1010 to be coupled with the first coupling portions 810 and the second coupling portion 820.

The fixer guide 1010 may have a cavity 1011. The fixer guide 1010 may be in the shape of a cylinder. The fixer guide 1010 may have a shape corresponding to the boss 811 of the first coupling portion 810. In the current embodiment of the present disclosure, an example in which the fixer guide 1010 is formed in the shape of a cylinder is shown. However, the shape of the fixer guide 1010 is not limited. For example, the fixer guide 1010 may have any shape corresponding to the coupling portions 810 and 820 formed in the second tub 220.

The fixer guide 1010 may pass through the fixer member installing portions 930 and the first insertion holes 910 of the second housing 230 to be connected to the first coupling portions 810 of the second tub 220. The fixer guide 1010 may be supported between the second tub 220 and the second housing 230. The fixer guide 1010 may support the second tub 220 and the lower frame 230 such that an interval between the second tub 220 and the lower frame 231 can be maintained. The fixer guide 1010 may be supported between the second tub 220 and the lower frame 231, so as to prevent the second tub 220 from moving when the washing machine 1 is transported.

The fixer member 1000 may include an elastic member 1030. The fixer guide 1010 may be coupled with the elastic member 1030. The elastic member 1030 may be formed in the shape of a ring made of a material having elasticity. The elastic member 1030 may be coupled with one end of the fixer guide 1010. The elastic member 1030 may be disposed between the fixer guide 1010 and the second housing 230. The elastic member 1030 may be disposed between the fixer guide 1010 and the first inserting hole 910 formed in the lower frame 231. The elastic member 1030 may elastically support the fixer guide 1010 and the lower frame 231.

Meanwhile, the fixer 1020 installed in the fixer guide 1010 may be a bolt. The fixer 1020 may pass through the cavity 1011 of the fixer guide 1010 to be coupled with the first coupling portions 810. The fixer 1020 may include a fixing support member 1021. The fixing support member 1021 of the fixer 1020 may support the fixer 1020 on the rear surface of the second housing 230 when the fixer 1020 is fixed.

Also, the fixer member 1000 may pass through the second inserting hole 920 formed in the first housing 130 to be coupled with the second coupling portion 820 of the second tub 220. The fixer guide 1010 may be supported between the second tub 220 and the first housing 130. The fixer guide 1010 may be supported between the second tub 220 and the side frame 131 such that an interval between the second tub 220 and the side frame 131 can be maintained. The fixer guide 1010 may be supported between the second tub 220 and the side frame 131 to prevent the second tub 220 from moving when the washing machine 1 is transported.

Since the washing machine according to the present disclosure has the plurality of washing apparatuses, it is possible to sort laundry and wash the laundry separately as necessary.

Also, the tub can be stably fixed through the fixer member detachably coupled with the rear portion of the tub to thereby be prevented from moving during transport to avoid product damage, and the tub can be reinstalled.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a first tub configured to form a front load washing space;

a second tub disposed above the first tub and configured to form a top load washing space;

a first housing configured to cover the first tub;

a second housing disposed on the first housing, and configured to cover the second tub;

a first coupling portion provided at a first position on an upper portion of a rear surface of the second tub while protruding toward the second housing to fix the second tub to the second housing so that the second housing is spaced apart from the rear surface of the second tub by the first coupling portion, a second coupling portion provided at a second position lower than the first position on a lower center portion of the rear surface of the second tub to fix the second tub to the first housing so that the first housing is spaced apart from the rear surface of the second tub by the second coupling portion;

a first fixer member configured to directly fix the first coupling portion to the second housing and a second fixer member configured to directly fix the second coupling portion to the first housing, wherein the first coupling portion includes a boss integrated into the second tub in such a way to protrude from the second tub, and a first coupling hole is formed in a center of the boss, wherein the boss includes a plurality of reinforcement ribs formed around the boss, wherein the second coupling portion includes a second coupling bracket extending integrally from the second tub, and a second coupling hole is formed in the second coupling bracket, wherein each of the first fixer member and the second fixer member includes a fixer guide having a cavity, and a fixer configured to pass through the fixer guide corresponding thereto, so as to be coupled with a corresponding one of the first coupling portion and the second coupling portion.

2. The washing machine according to claim 1, wherein the first coupling hole is provided to fix the second tub to the second housing.

3. The washing machine according to claim 1, wherein the second coupling hole is provided to fix the second tub to the first housing.

4. The washing machine according to claim 1, wherein the second housing includes an upper frame including an entrance through which laundry is put into the second tub, and a lower frame disposed below the upper frame.

5. The washing machine according to claim 4, wherein the lower frame includes a first inserting hole formed to correspond to the first coupling hole.

6. The washing machine according to claim 5, wherein the first housing includes a second inserting hole formed to correspond to the second coupling hole.

7. The washing machine according to claim 5, wherein the second housing further includes a rear cover.

8. The washing machine according to claim 6, wherein the second coupling hole is formed below the first coupling hole.

* * * * *